United States Patent [19]

Corbierè

[11] Patent Number: 4,725,486

[45] Date of Patent: Feb. 16, 1988

[54] FABRIC HAVING THREE DIMENSIONAL RELIEF

[75] Inventor: Claude Corbierè, La Tour De Salvagny, France

[73] Assignee: Corbiere, S.A., La Tour De Salvagny, France

[21] Appl. No.: 29,715

[22] Filed: Mar. 24, 1987

Related U.S. Application Data

[63] Continuation-in-part of Ser. No. 709,329, Mar. 7, 1985, Pat. No. 4,660,261.

[51] Int. Cl.[4] ..... D03D 3/00

[52] U.S. Cl. ..... 428/224; 428/225; 428/257

[58] Field of Search ..... 428/152, 225, 229, 257

[56] References Cited

U.S. PATENT DOCUMENTS

| | | | |
|---|---|---|---|
| 1,513,054 | 10/1924 | Lipstate . | |
| 1,592,359 | 7/1926 | Hawk . | |
| 2,823,444 | 2/1958 | Davies et al. | 28/76 |
| 2,869,976 | 1/1959 | Cole | 8/151 |
| 2,971,241 | 2/1961 | Clendening, Jr. | 26/1 |
| 3,109,278 | 11/1963 | Gibson | 428/229 |
| 3,325,871 | 6/1967 | Thompson | 26/18.6 |
| 3,425,110 | 2/1969 | Willis | 28/75 |
| 3,922,404 | 11/1975 | Priester | 427/369 |
| 3,987,519 | 10/1976 | Potosnak et al. | 26/69 R |
| 4,670,317 | 6/1987 | Greenway | 428/229 |

FOREIGN PATENT DOCUMENTS

| | | | |
|---|---|---|---|
| 45-36360 | 11/1970 | Japan . | |
| 0115145 | 7/1983 | Japan | 428/229 |
| 59-43165 | 3/1984 | Japan . | |
| 1028044 | 2/1986 | Japan | 428/229 |

*Primary Examiner*—James J. Bell

*Attorney, Agent, or Firm*—Parkhurst & Oliff

[57] ABSTRACT

A fabric having three dimensional relief is disclosed. The relief includes a succession of non-crepe like raised patterns in the forms of diamonds and diamond tips. The raised patterns are disposed in several directions both in warp and in weft. The dimensions of the patterns are variable along the warp and the fabric is waved in the weft direction.

6 Claims, 12 Drawing Figures

FABRIC HAVING THREE DIMENSIONAL RELIEF

CROSS-REFERENCE TO RELATED APPLICATION

This application is a continuation-in-part of U.S. patent application Ser. No. 709,329 filed Mar. 7, 1985, now U.S. Pat. No. 4,660,261, issued Apr. 28, 1987.

FIELD OF THE INVENTION

The invention relates to a cloth having three dimensional relief. More specifically, the cloth has a succession of non-crepe like raised patterns in the form of diamonds and diamond tips. The pattern of diamond and diamond tips is disposed in several directions, both in warp and in weft. The dimensions of the patterns are variable along the warp and the fabric is waved in the weft direction. The fabric is suitable for clothes, home furnishings or wall coverings.

BACKGROUND OF THE INVENTION

Known cloths are pleated longitudinally (direction of warp) or transversally (direction of weft). Moreover, crepe-like cloth is known in which patterns in the cloth are slightly raised to provide extension characteristics. For example, U.S. Pat. No. 3,828,444 to Davis et al discloses a creped bandage-type cloth wherein the bandage is rolled on a spindle which is then removed while the roll is shrunk and compressed. The resulting bandage is creped and extensible. In addition, U.S. Pat. No. 3,325,871 to Thompson and Japanese Reference No. 45-36360 disclose crepe-like fabrics with very small undulated surfaces which increase the stretch characteristics of the fabrics. The latter two references teach the production of the disclosed fabric by rolling the fabric on a mandrel and then compressing the fabric while the fabric remains supported on the mandrel.

The crepe-like effects of the known fabrics are obtained from significant twisting of each yarn of the fabric. Such twisting creates localized torque in each yarn, thereby causing the yarn to function like a spring and the fabric as a mass of entangled springs.

The known cloths, however, fail to provide significant relief effects (i.e., greater than crepe-like effects) in both the warp and weft directions. For example, in crepe-like fabrics, the length of one side of the relief effect remains less than 5 mm. Further, it is difficult to vary the dimensions of the relief effects in crepe-like cloths. The known fabrics are also not as bulky as desired.

It is the object of the invention to provide a cloth having significant non-crepe like relief effects in both the warp and weft directions.

It is another object of the invention to provide a cloth having relief effect in which the length of the relief effect is 10 mm or more.

It is a further object of the invention to provide a cloth having relief effects whose dimensions vary.

It is an additional object of the invention to provide a cloth having increased bulk in relation to known crepe-like fabrics.

It is another object of the invention to provide a cloth with three dimensional relief and increased bulk which is suitable for clothes, home furnishings or wall coverings.

SUMMARY OF THE INVENTION

The invention relates to a fabric having three dimensional relief, the relief including a succession of non-crepe like raised patterns in the form of diamonds and diamond tips. The raised patterns in the form of diamonds and diamond tips are disposed in several directions both in warp and weft. The dimensions of the patterns are variable along the warp and the fabric is waved in the weft direction.

BRIEF DESCRIPTION OF THE DRAWINGS

The inventive cloth will be described in relation to the attached drawings and photographs which are intended to be illustrative and not limiting. In the following figures, like reference numerals refer to like elements and.

BACKGROUND AND SUMMARY OF THE INVENTION

Figure 1:
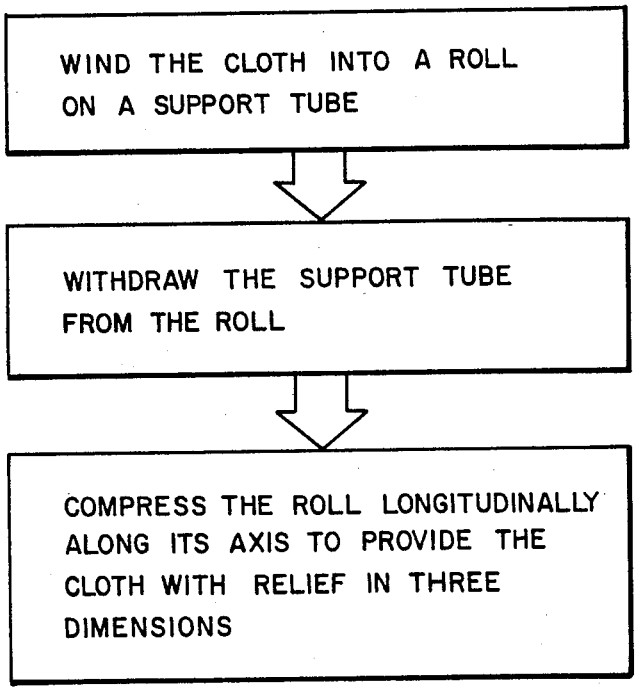
FIG. 1 is a flow chart illustrating the steps in the process of producing the fabric having the relief effects of the present invention.

The process for obtaining the inventive cloth is illustrated in the flow chart of FIG. 1. Generally, the inventive cloth is produced by winding a fabric into a roll on a support tube. Any fabric is suitable, but synthetic fibers (e.g., polyester yarns) and taffeta weaves are preferable cloths. Natural fibers are also suitable if coated with a resin to provide a thermo-plastic type characteristic to the fabric.

After formation of the roll, the support tube is withdrawn from the roll which is subsequently compressed longitudinally along its axis. Compression of the roll after withdrawal of the support tube does not place any limitations on the deformation of the fabric during compression. As a result of the unrestricted compression, the cloth presents a succession of noncrepe like raised patterns in the form of diamonds and diamond tips disposed in several directions, both in warp and in weft.

Figure 2:
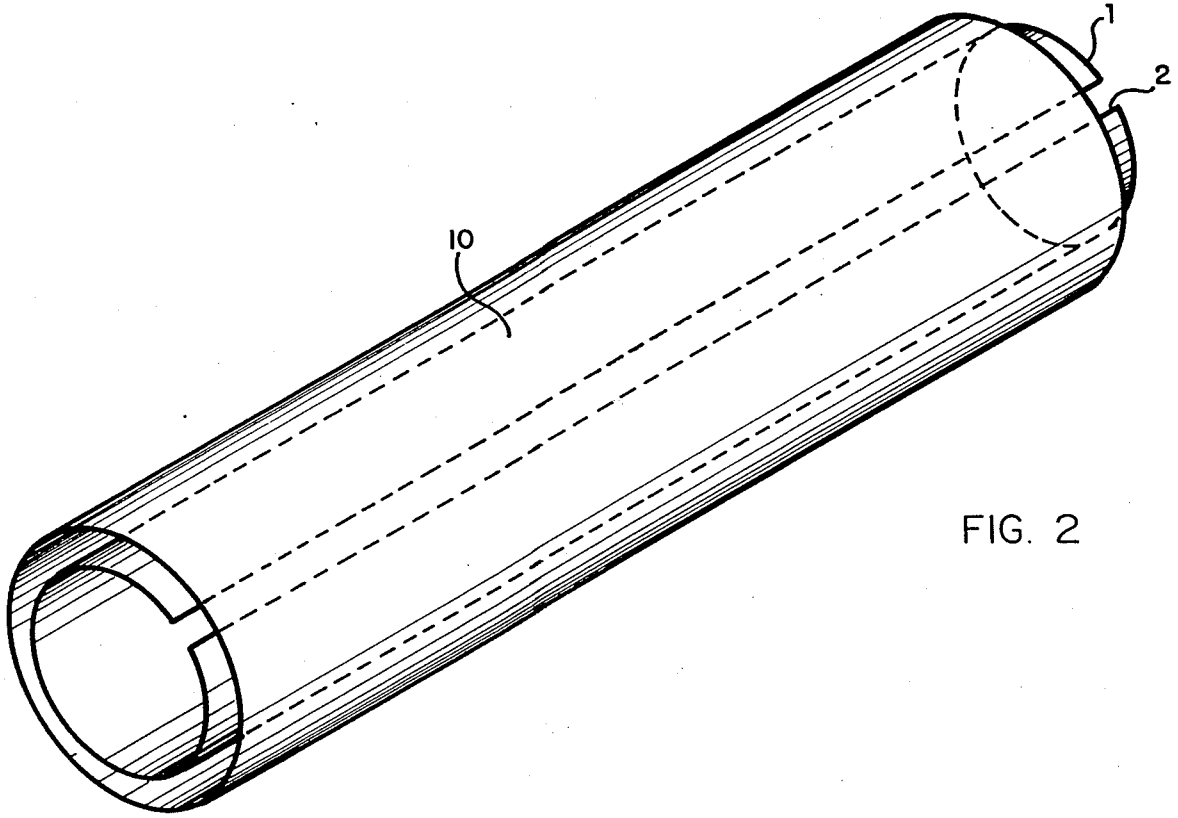
FIG. 2 is a schematic perspective view of a fabric roll in which the fabric is rolled on a support tube.
Figure 3:
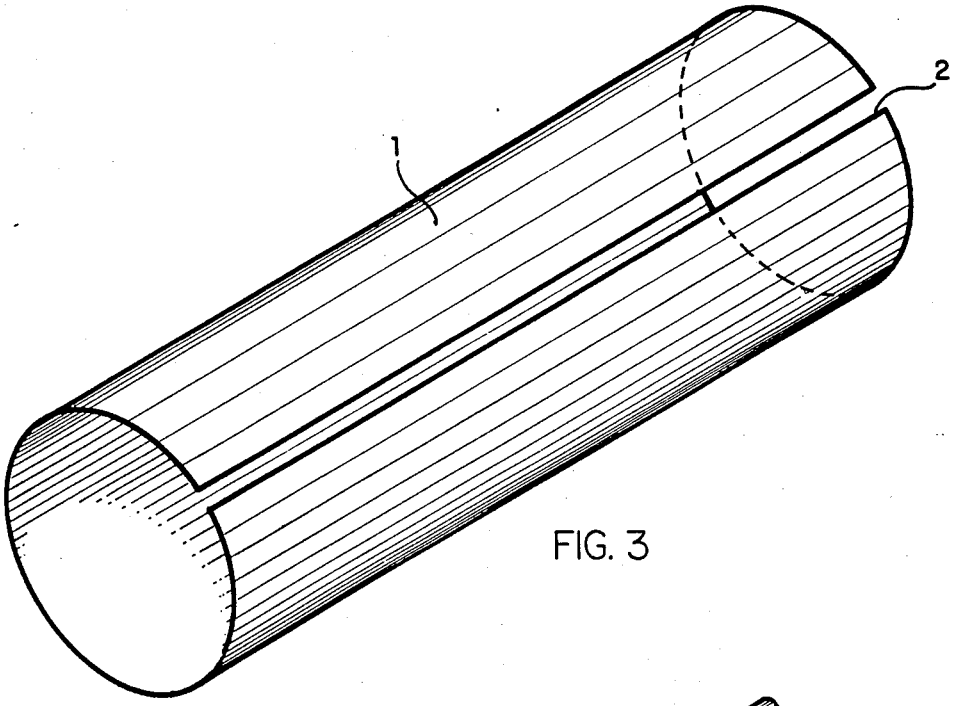
FIG. 3 is a schematic perspective view of one embodiment for the support tube on which the fabric of FIG. 2 is rolled.
Figure 7:
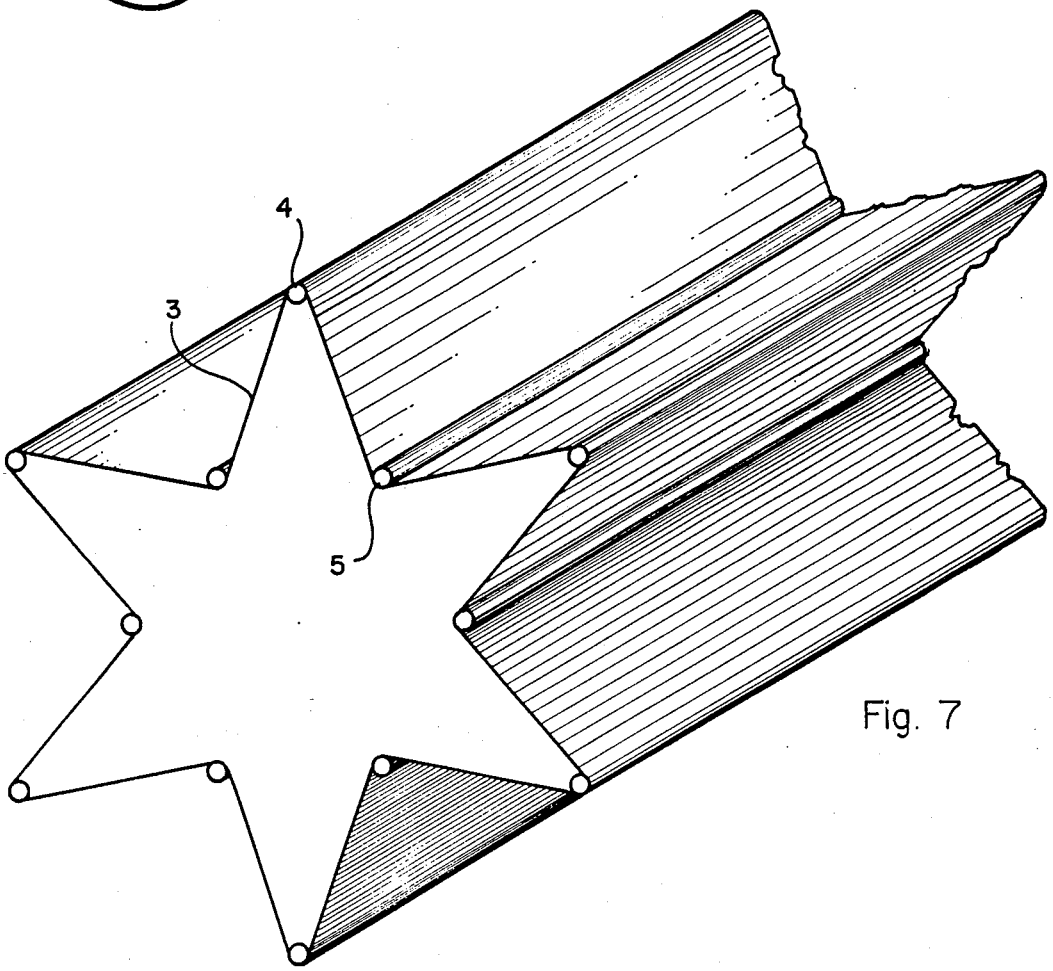
FIG. 7 is a schematic perspective view of one end of a roll of fabric disposed in a quinqunx around 12 parallel bars.

The process of FIG. 1 is illustrated in detail in FIGS. 2–7. In FIG. 2, the cloth is wound under normal tension on a first support tube 1 to obtain a roll 10 of average hardness. The first support tube 1 may be split along its generatrix 2 as illustrated in FIG. 3. Alternatively, the first tube may be a hollow plastic tube or an inflated elastic tube.

Figure 4:
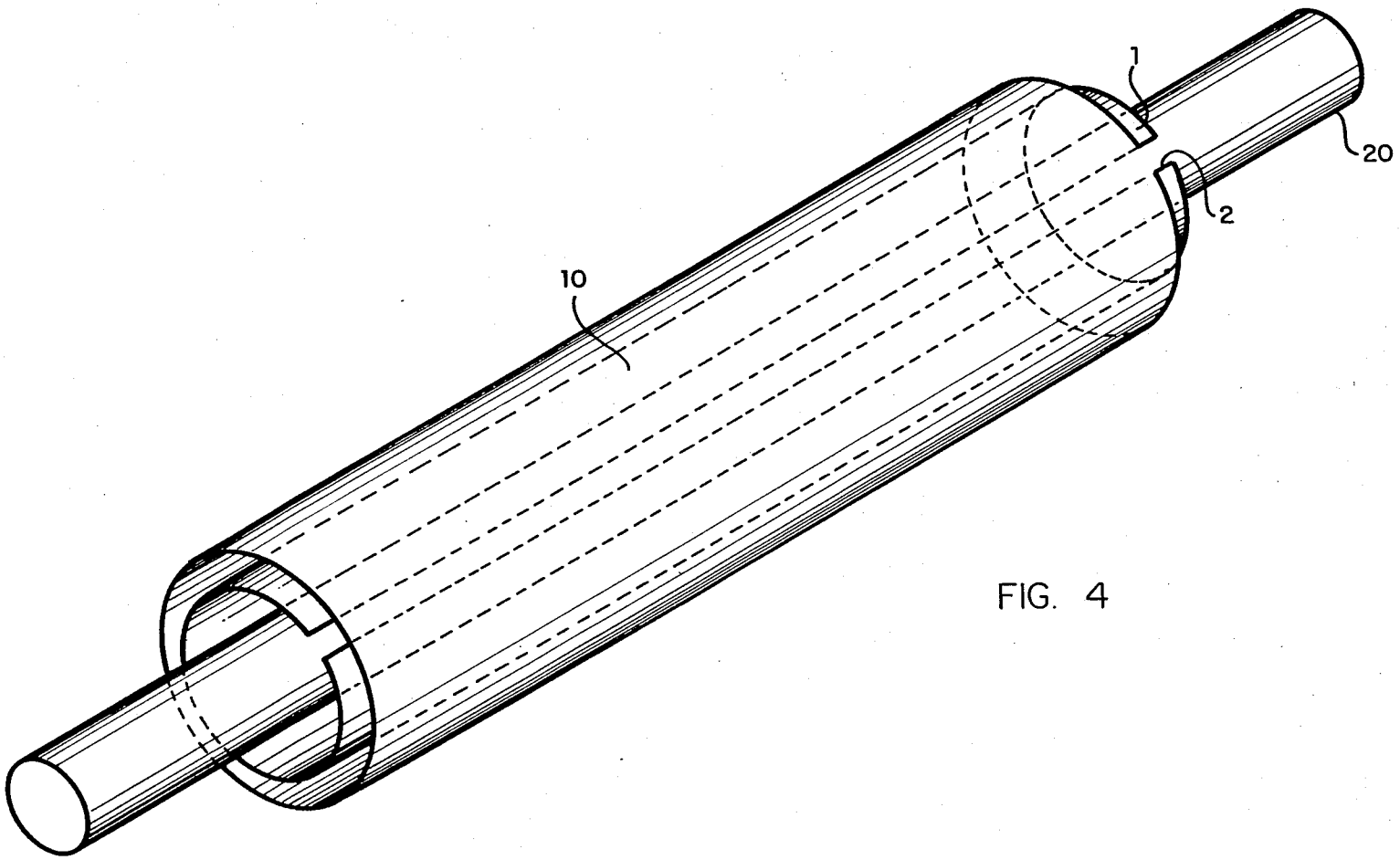
FIG. 4 is a schematic perspective view of the roll of FIG. 2 in which an inner tube is placed within the support tube.
Figure 5:
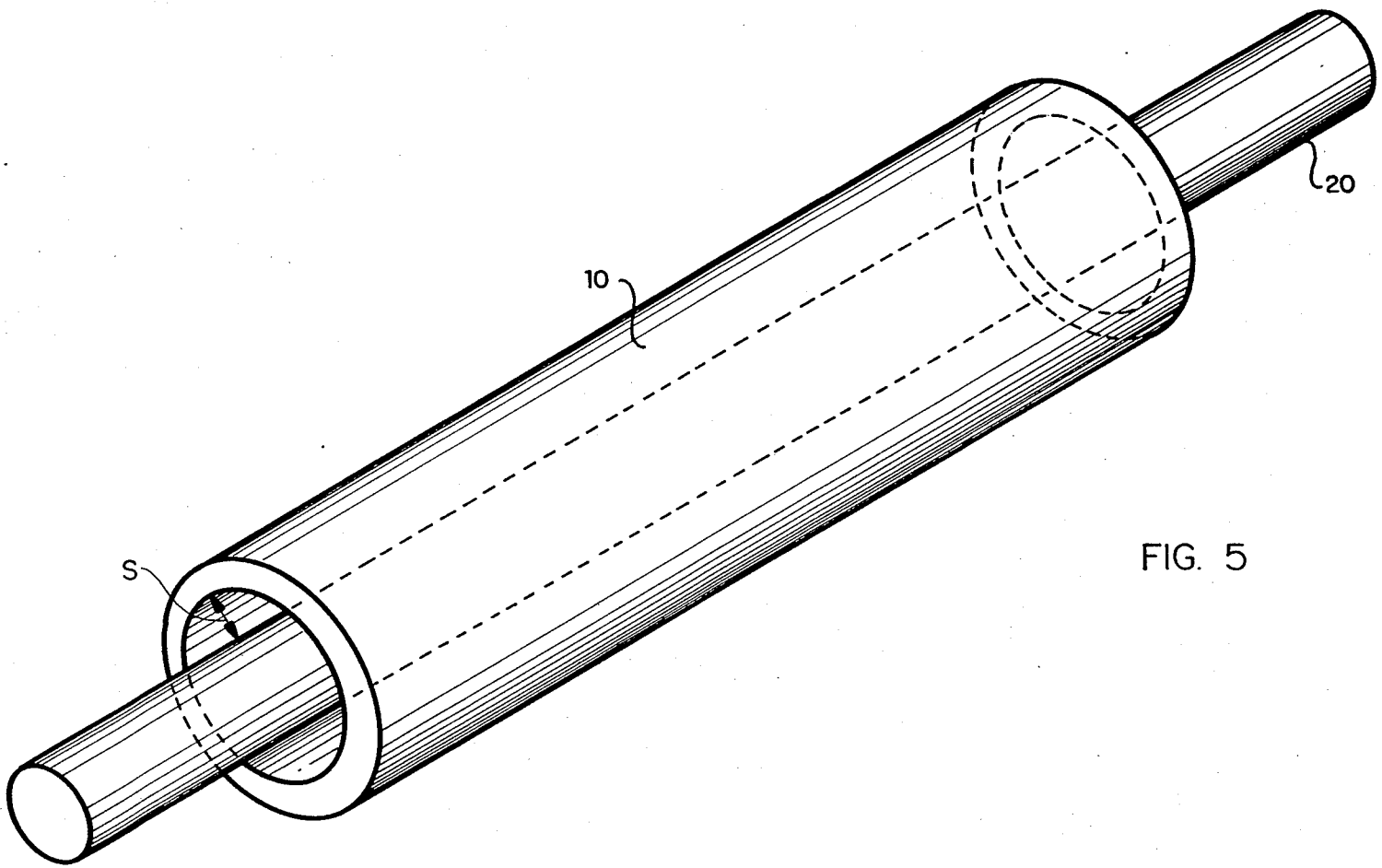
FIG. 5 is a schematic perspective view of the roll of FIG. 4 with the support tube removed.
Figure 6:
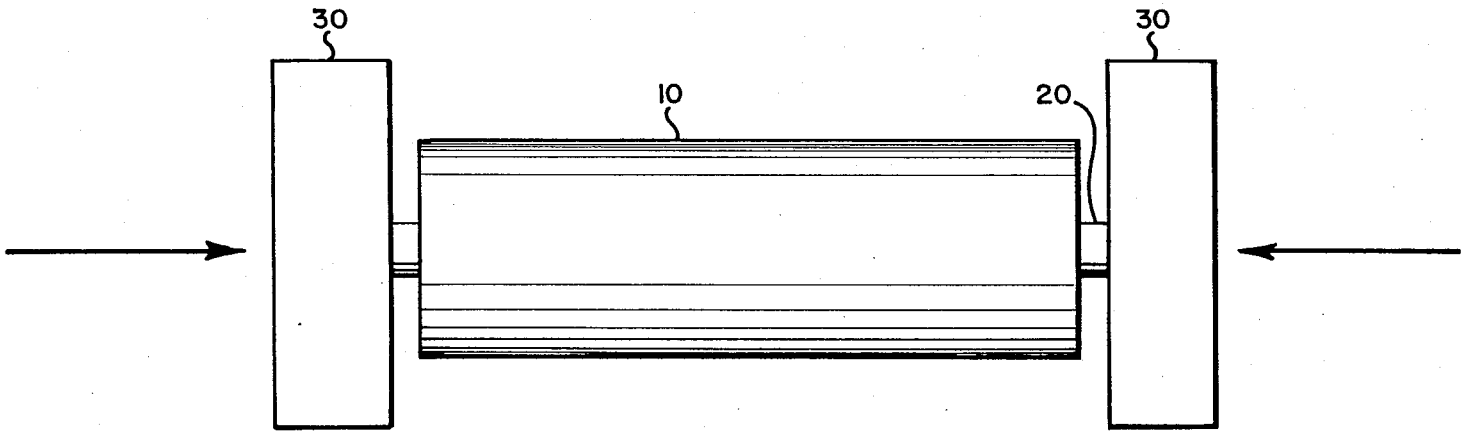
FIG. 6 is a schematic view of the roll of FIG. 5 with slide rings located on the inner tube for longitudinal compression of the roll.

A second tube 20, preferably made of stainless steel, is then placed in the first tube as illustrated in FIG. 4. The second tube 20 has an outside diameter less than the inside diameter of the first tube. The first tube is then withdrawn as illustrated in FIG. 5. After withdrawal, a space S exists between the inner surface of the roll and the outer surface of the second tube.

With the first tube withdrawn, slide rings 30 (FIG. 6) are introduced on each end of the second tube. The slide rings 30 are forced axially as close as possible toward each other, thereby compressing the roll in the longitudinal direction of the roll and second tube. This type of compression is known to those skilled in the art, for example, as disclosed U.S. Pat. No. 3,325,871 to Thompson (the disclosure of which is herein incorporated by reference) in which compression occurs without withdrawal of the first support tube. In the present method for producing the inventive cloth, the support tube is withdrawn prior to compression so that the deformation of the cloth is not limited by the adjacent interior support tubes. The cloth thus deforms inwardly into the space S between the inner surface of the roll and the outer surface of the second tube. Those skilled in the art recognize that the roll wound on the first support tube may be placed within an outer tube with subsequent withdrawal of the support tube. Longitudinal compression of the roll by slide rings axially moving within the outer tube results in the cloth deforming into the space formerly occupied by the first support tube, the deformations of the cloth not being limited by any internal support.

When suitable compression of the roll is achieved, the position of the slide rings is fixed by cotter pins or other securing mechanisms to maintain the roll in a compressed state. The deformations formed in the roll by compression are subsequently set in the cloth by heat treatment such as placing the compressed roll in a steam bath or other saturating vapor. After cooling and unwounding, a fabric is obtained which presents a series of three dimensional relief effects in all directions, both in warp and in weft. The relief effect resembles diamonds or diamond tips whose dimensions vary in the warp direction. More specifically, the dimensions of the elements increase from the interior of the roll toward the outside of the roll as a function of the increase in diameter of the roll.

The diamond and diamond tip relief effect is significantly different from crepe-like effects. In particular, the diamond and diamond tip relief effect does not result from the twisting of yarn as in crepe fabrics, but results from the deformation after withdrawal of the support tube and subsequent heat setting. Moreover, as described in more detail below, the inventive diamond and diamond tip relief effect produces sides of the diamonds having an average length of 10 mm or more, whereas in crepe-like fabrics the length cannot exceed 5 mm.

It is noted that the fabric can be wound on the first tube with a compressible material which is interposed between each wrap of the fabric. The compressible material may be a plastic foam sheet which preferably presents a heat-adhesive face. After compression and heat treatment, the face of the compressible material adheres to the fabric to form a foam-lined product having the relief effects described above.

In a second embodiment, after withdrawal of the support tube 1, the roll 3 is disposed around 12 parallel bars 4, 5 (FIG. 7) disposed in a quincunx on either side of a circle having a radius of preferably about 120 centimeters. The outer bars 4 and inner bars 5 are alternately placed outside and inside the circle. The outer bars 4 are enveloped by the interior of the roll, while the inner bars 5 are enveloped by the outside of the roll. In other words, the roll is not unwound but is used as a soft tube. The soft tube is engaged around the six outer bars 4 and then six more additional bars 5 are engaged from the outside, each bar 5 being located between two contiguous bars 4 so as to form the quincunx. This type of arrangement is known to those skilled in the art, for example, as disclosed in U.S. Pat. Nos. 2,971,241 and 2,869,976 (the disclosures of which are herein incorporated by reference).

Slide rings are then placed on the ends of the bars 4, 5 and moved axially inward to compress the roll without being restricted by an inner support tube. After compression by the slide rings, the fabric resulting from the sinusoidal roll of the second embodiment includes the diamonds and diamond tips pattern of the first embodiment, along with a regular lengthwise crimp which provides waves in the weft direction. The wave in the weft direction provides additional bulk to the inventive fabric.

Figure 9:
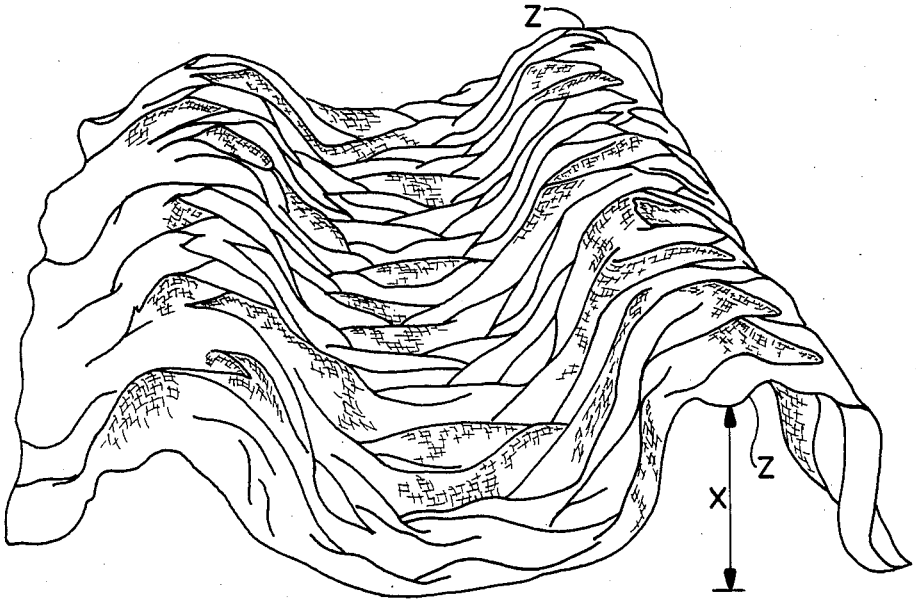
FIG. 9 is a schematic perspective view of the inventive fabric illustrating two waves in the weft direction.
Figure 8:
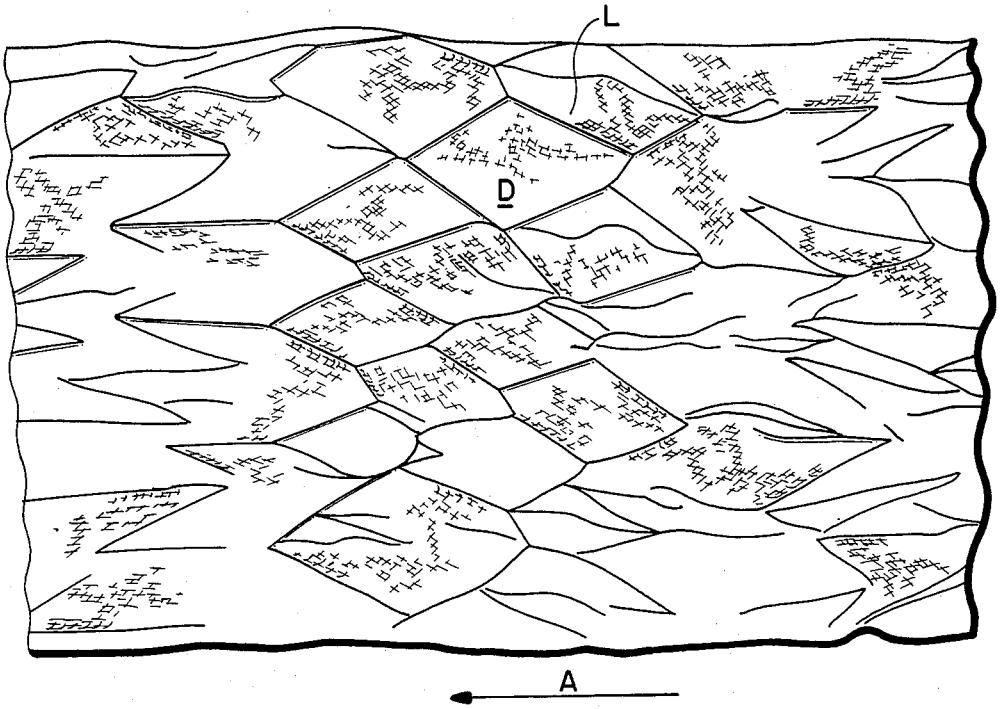
FIG. 8 is a two-dimensional top surface view of the relief effects obtained in the fabric.

To illustrate the relief effects, FIG. 8 is a two-dimensional top surface view of the relief effect obtained in the fabric, but does not illustrate the waves in the weft direction. The relief effect includes diamonds and diamond tipped shaped patterns defined by lines of deformation in the fabric. The lines of deformation extend transverse to both the warp and weft directions. Each side of the diamond D has an average length L which exceeds 10 mm. Moreover, the dimensions of the patterns vary in the warp direction as the diameter of the roll increases (illustrated in FIG. 8 with arrow A). In FIG. 9 which is a perspective view of the inventive fabric, waves denoted by transverse lines Z—Z are set in the weft direction from the lengthwise crimp. The waves provide the fabric with a sine wave-type surface with alternating peaks and valleys. The distance X between an adjacent peak and valley is a function of the arrangement of the quincunx of FIG. 7, the cycle of the waves varying directly with an increasing number of bars and the height of the waves varying directly with an increasing size of the bars. The diamond and diamond tip patterns extend throughout the waves and across the entire surface of the fabric.

Figure 10:
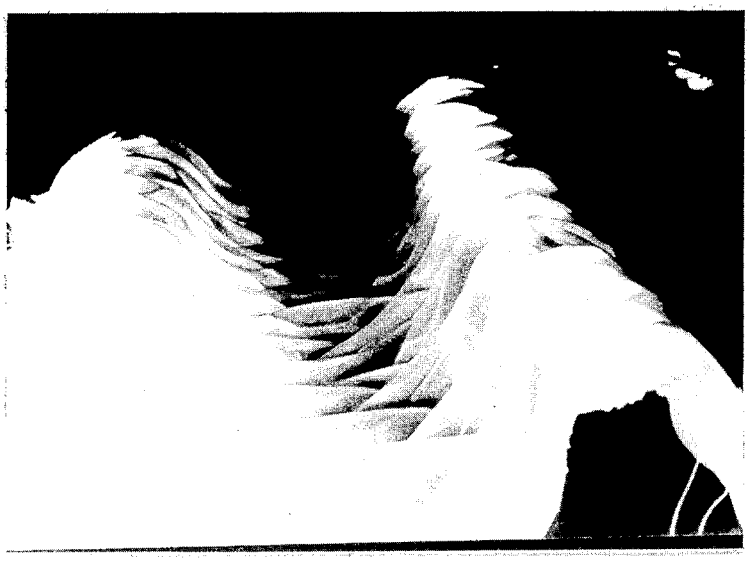
FIGS. 10–12 are photographs of the inventive fabric.
Figure 11:
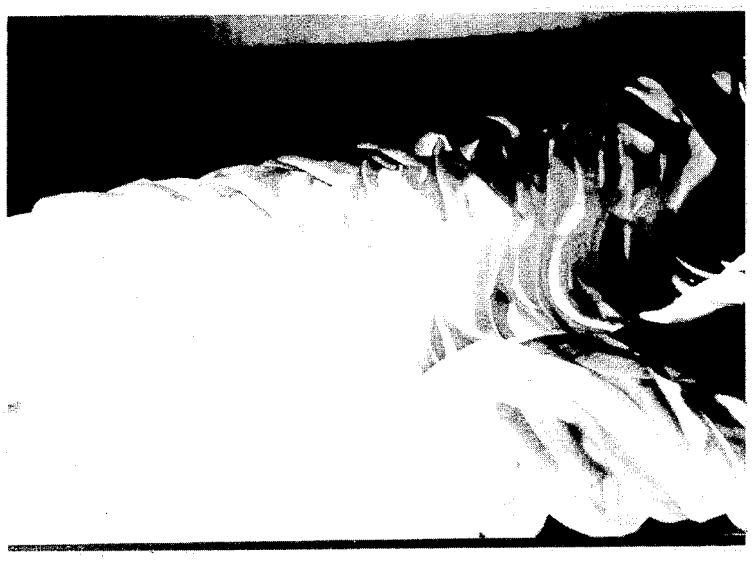
Figure 12:
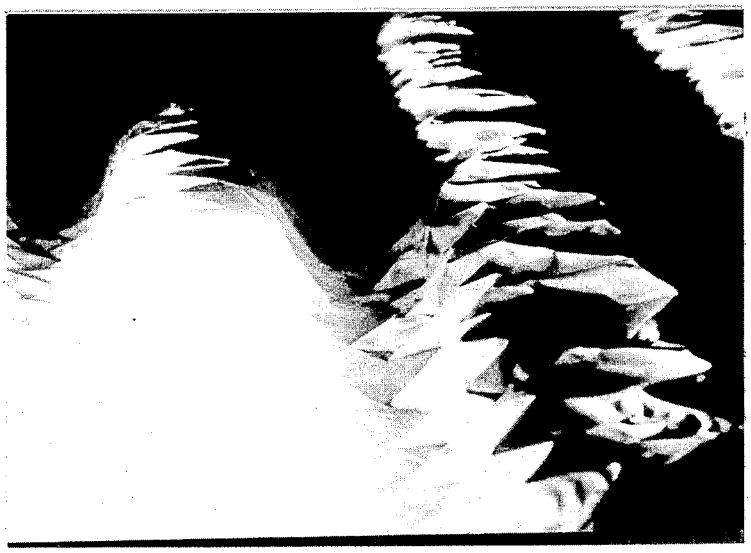

The extent to which the fabric is provided with the foregoing relief effects is readily discernible from a review of FIGS. 10–12 which are photographs of the novel fabric. The photographs clearly illustrate the waves in the weft direction due to the lengthwise crimp in the fabric. Moreover, the photographs illustrate the diamond and diamond tip shaped patterns which are formed in the fabric throughout the waves and across the surface of the fabrc. The diamond and diamond tip shaped patterns provide a three dimensional relief effect with the patterns being defined by lines of deformation which extend transversely to the warp and weft directions. Moreover, the waves in the weft directions due to the lengthwise crimp provide the novel fabric with increased bulk over known crepe-like fabrics.

The manner in which the novel fabric is produced and the advantages flowing therefrom will be more readily understood from the following examples which are for illustrative, non-limiting purposes.

EXAMPLE 1

Fifty (50) meters of a polyester fabric, taffeta weave, were wound on a hollow plastic tube with an outer diameter of 40 millimeters. The fabric was 160 centimeters wide and weighed 65 grams per linear meter. The winding of the roll was achieved with normal tension. A second tube having a diameter of 30 millimeters was placed within the 40 millimeter tube thereby providing a space of about 10 millimeters between the tubes. The 40 millimeter hollow plastic tube was then withdrawn and the roll was compressed thereby forcing the roll into the 10 millimeter space between the inner surface of the roll and the outer surface of the second tube. The compressed roll was then placed in a saturated vapor at over a 140° C. for 30 minutes. The fabric obtained had relief in all directions which relief resembled diamond and diamond shaped tips. Moreover, the dimensions of each relief pattern increased from the interior of the roll toward the outside thereof, as a function of the increase in diameter of the roll.

EXAMPLE 2

In this example, the plastic tube of Example 1 was replaced by a rigid tube of stainless steel split along its generatrix. The split tube had an outer circumference of 1 meter and an outside diameter of 32 centimeters. FIfty (50) meters of the same fabric as Example 1 were wound on the tube. Slide rings having an internal diameter of 32 centimeters were placed on the split tube and moved axially along the tube to compress the roll. The split roll decreased in diameter as the roll was compressed. The deformations of the compressed roll were set under the same conditions as in Example 1.

When compared to the fabric of Example 1, the relief pattern had larger dimensions due to the larger outside diameter of the initial support tube. While the dimensions of the pattern increased as a function of increasing diameter of the roll, the rate of increase is less than that for the fabric of Example 1 due to the larger circumference of the tube in Example 2.

EXAMPLE 3

A roll of fabric is obtained under the same conditions as in Example 2, but after withdrawal of the support tube, the roll is disposed in a sinusoidal manner around 12 parallel bars disposed in a quincunx on either side of the circle having a radius of a 120 centimeters. After compression on the bars, the deformations are set under the same conditions as Examples 1 and 2.

Beside obtaining the relief patterns described in Examples 1 and 2, the fabric obtained in accordance with Example 3 includes a regular lengthwise crimp which produces a wave in the fabric in the weft directions. The fabric of Example 3 had increased bulk over the fabrics in Examples 1 and 2 and known crepe-like fabrics.

EXAMPLE 4

A woven fabric made in warp and weft with polyester yarns monofilament 22 dtex was wound on a split tube as illustrated in FIG. 2. The fabric had a width of 150 centimeters and a weight of 20 grams per linear meter. The split tube was crushed to remove it from the wound fabric. The fabric was then placed on 6 bars similar to the outer bars 4 in FIG. 7. Each bar had a diameter of one inch and the distance between two opposed bars was about 30 centimeters. Additional inner bars, similar to the inner bars 5 in FIG. 7 were placed on the roll to form a quinqunx. The ends of the bars were located in an opposed plate which were moved longitudinally to compress the fabric along the bars. After withdrawal of the bars, the fabric is set in a autoclave in wet vapor for 30 minutes at 130° C.

The fabric obtained includes the diamond and diamond tip relief patterns as illustrated in FIGS. 8–9 and photographs 10–12. Further, the fabric has increased bulk due to the waves in the weft direction formed by the lengthwise crimp in the fabric. The bulk attributable to the waves in the weft direction is illustrated in the fabrics of FIGS. 10–12.

EXAMPLE 5

A fabric was rolled and placed under the same conditions as in Example 4. However, the fabric in this example was a polyester fabric in warp and weft having the following characteristics: 50 dtex/22 filaments; weights 65 grams per linear meter; and 140 centimeters in width. Similar relief effects as those described in connection with Example 4 were obtained.

EXAMPLE 6

A fabric was rolled and produced under the same conditions as in Example 4 except that 8 bars with a 40 millimeter diameter were employed rather than the 6 bars of the 1-inch diameter. The fabric was 100% polyester.

The fabric having the relief effects described in connection with Example 4 was obtained.

EXAMPLE 7

A fabric was produced under the same conditions as in Example 4 but with a silk fabric (yard 20 deniers) and a weight of 12 grams per linear meter. A fabric having similar relief effects as those of Example 4 was obtained.

In accordance with 37 CFR 1.93, samples of the fabrics obtained by the procedures of Examples 4–7 can be supplied if desired.

Various modifications can be made to obtain novel fabric relief effects. For example, the textile material and/or its stiffness may be changed to vary the relief effects. In addition, the diameter of the bars for the sinusoidal roll may be varied. If the bars have a small diameter, the resulting pattern has a small dimension. Moreover, the location of the bars may be varied by changing the distance between opposed bars and/or the angle between adjacent bars. The relief effect is also varied by the diameter of the inital roll as discussed in connection with Examples 2 and 3.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A fabric having three dimensional relief, said relief comprising a succession of non-crepe like raised patterns in the form of diamonds and diamond tips, disposed in several directions both in warp and in weft, the dimensions of the patterns being variable along the warp, and the fabric being waved in the weft direction.

2. The fabric of claim 1 wherein sides of the diamond and diamond tip pattern each have an average dimension at least as great as 10 mm.

3. The fabric of claim 1 wherein the waves in the weft direction constitute a series of lengthwise crimps for providing additional bulk to the fabric.

4. The fabric of claim 1 wherein the raised patterns in the form of diamonds and diamond tips are defined by lines of deformation in the fabric, the lines of deformation transversing the warp and weft directions of the fabric.

5. The fabric of claim 1 wherein the fabric is made from a synthetic fiber.

6. The fabric of claim 5 wherein the fabric is polyester.

* * * * *